US005462450A

United States Patent [19]

Kodama

[11] Patent Number: 5,462,450

[45] Date of Patent: Oct. 31, 1995

[54] CONNECTOR DISCONNECTION SENSING MECHANISM

[75] Inventor: Shinji Kodama, Shizuoka, Japan

[73] Assignee: Yazaki Corporation, Tokyo, Japan

[21] Appl. No.: 375,270

[22] Filed: Jan. 19, 1995

Related U.S. Application Data

[63] Continuation of Ser. No. 115,655, Sep. 3, 1993, abandoned.

[30] Foreign Application Priority Data

Sep. 7, 1992 [JP] Japan ..... 4-062637 U
Mar. 8, 1993 [JP] Japan ..... 5-009445 U

[51] Int. Cl.[6] ..... H01R 3/00

[52] U.S. Cl. ..... 439/489; 439/357

[58] Field of Search ..... 439/488, 489, 439/350, 351, 352, 353, 354, 355, 357, 358, 924

[56] References Cited

U.S. PATENT DOCUMENTS

| | | | |
|---|---|---|---|
| 3,867,000 | 2/1975 | Michalak et al. | 439/355 |
| 4,734,052 | 3/1988 | Vandame | 439/354 |
| 4,867,699 | 9/1989 | Oda et al. | 439/355 |
| 4,915,643 | 4/1990 | Samejima et al. | 439/489 |
| 5,224,872 | 7/1993 | Noda et al. | 439/282 |
| 5,246,380 | 9/1993 | Kodama | 439/354 |
| 5,338,211 | 8/1994 | Kodama et al. | 439/489 |

*Primary Examiner*—Gary F. Paumen
*Assistant Examiner*—Hien D. Vu
*Attorney, Agent, or Firm*—Finnegan, Henderson, Farabow, Garrett & Dunner

[57] ABSTRACT

A connector disconnection sensing mechanism of a switch connector for switching a circuit by connecting or disconnecting the connector, wherein operation sensitivity is improved when the connector is disconnected. The connector disconnection sensing mechanism includes a resilient disconnection sensing arm with a projection attached to one of mateable connector halves; and a guide projection attached to the other connector half. The guide projection has an engagement face with a gentle slope and a falling face with a steep slope which contact the projection of the resilient disconnection sensing arm in that order when either one of the mateable connector halves is drawn out, wherein the projection of the resilient disconnection sensing arm is positioned on the side of the falling face of the guide projection when the mateable connector halves are disconnected.

5 Claims, 7 Drawing Sheets

CONNECTOR DISCONNECTION SENSING MECHANISM

This application is a continuation of application Ser. No. 08/115,655, filed Sep. 3, 1993, now abandoned.

BACKGROUND OF THE INVENTION

1. Field of the Invention

The present invention relates to a connector disconnection sensing mechanism of a switch connector or the like for switching a circuit by connecting or disconnecting the connector, wherein operation sensitivity at the disconnection of the connector is improved.

2. Description of the Prior Art

FIG. 7 is a longitudinally cross-sectional view of a conventional switch connector, which is disclosed in Japanese utility model application No. Heisei 3-84573.

The switch connector 1' comprises a slide female connector half 2' with a terminal 16, and a fixed male connector half 5' with a mated terminal 17. A resilient locking arm 12 and a locking projection 20 for preventing the slide connector half 2' from slipping off are formed on an outer wall 3' of the slide connector half 2'. Further, a locking wall 19 engaging a locking projection 18 of the locking arm 12, and a locking projection 21 engaging the locking projection 20 are formed on a housing 6' of the fixed connector half 5'. The connector half 5' is fixed to an electrical junction box or the like not shown at a mounting portion (22 in FIG. 1) of the outer wall of the housing 6'.

An inner wall 25 of a locking chamber of the slide connector half 2' slidably contacts a seal coating 24 on an outer wall 23 of terminal accommodating cavities of the fixed connector half 5' to connect the terminal 16 to the mated terminal 17 on the side of the circuit 26 and to connect the locking projection 18 of the locking arm 12 to the locking wall 19. When the circuit 26 is cut off, the slide connector half 2' is drawn with the locking arm 12 being deflected, and the projection 20 comes into contact with the projection 21 to prevent the slide connector half 2' from slipping off.

However, with the conventional construction described above, the slide connector half 2' should strongly be drawn out while depressing an operating portion 27 of the resilient locking arm 12 at the cutoff of the circuit. Therefore, it is difficult to sense the abutment between the projections 20 and 21 due to a strong friction resistance between the seal coating 24 and the inner wall 25 of the locking chamber. As a result, there is a fear of incomplete connection of the circuit 26, that is, an incomplete cutoff of the connector 1'.

SUMMARY OF THE INVENTION

The present invention has been accomplished to eliminate the drawbacks of the conventional connector disconnection sensing mechanism described above and the object thereof is to provide a connector disconnection sensing mechanism in which an operation sensitivity at the disconnection of the connector is improved to securely cut off a circuit or the like.

A connector disconnection sensing mechanism according to one embodiment of the present invention comprises: a resilient disconnection sensing arm with a projection attached to one of mateable connector halves; and a guide projection attached to the other connector half, the guide projection having an engagement face with a gentle slope and a falling face with a steep slope, which contact the projection of the resilient disconnection sensing arm in that order when either one of the mateable connector halves is drawn out, wherein the projection of the resilient disconnection sensing arm is positioned on the side of the falling face of the guide projection when the mateable connector halves are disconnected.

In this embodiment, the connector half slides in the direction that the connector halves are disconnected to cause the projection of the disconnection sensing arm to slide on an engagement face of the guide projection. Then, the moment the terminals are disconnected, the projection of the disconnecting sensing arm falls on the side of the falling face of the guide projection, which allows the resilient arm to rapidly recovery its original shape. As a result, workers can sense the disconnection of the connector by impact and sound caused by the collision of the arm and guide projection.

A connector disconnection sensing mechanism according to another embodiment of the present invention comprises: a fixed projection with an engagement face with a gentle slope and a falling face with a steep slope, the fixed projection attached to one of mateable connector halves; and a resilient disconnection sensing arm with a movable projection at a side face thereof. The resilient disconnection sensing arm is attached to the other connector half, wherein the movable projection engages the engagement face of the fixed projection when the connector halves move from a disconnected state to a connected state, and the movable projection engages the falling face of the fixed projection when the connector halves move from the connected state to the disconnected state, and the movable projection falls from the falling face of the fixed projection and the resilient disconnection sensing arm returns to its original position when the connector halves are disconnected.

In this embodiment, when the connector is connected the movable projection of the disconnection sensing arm crosses over the fixed projection and is situated in front of the fixed projection. Then, the movable projection moves up along a climbing face of the fixed projection to bend the disconnection sensing arm when the connector is disconnected, and after that, the movable projection falls from a top of the climbing face to cause the disconnection sensing arm to recover its original shape, which permits the workers to sense the disconnection of the connector by impact and sound.

BRIEF DESCRIPTION OF THE DRAWINGS

The present invention will be more apparent from the ensuring description with reference to the accompanying drawing wherein.

FIG. A is a perspective view of a connector disconnection sensing mechanism according to a first embodiment of the present invention.

DETAILED DESCRIPTION OF PREFERRED EMBODIMENTS

Figure 1A:
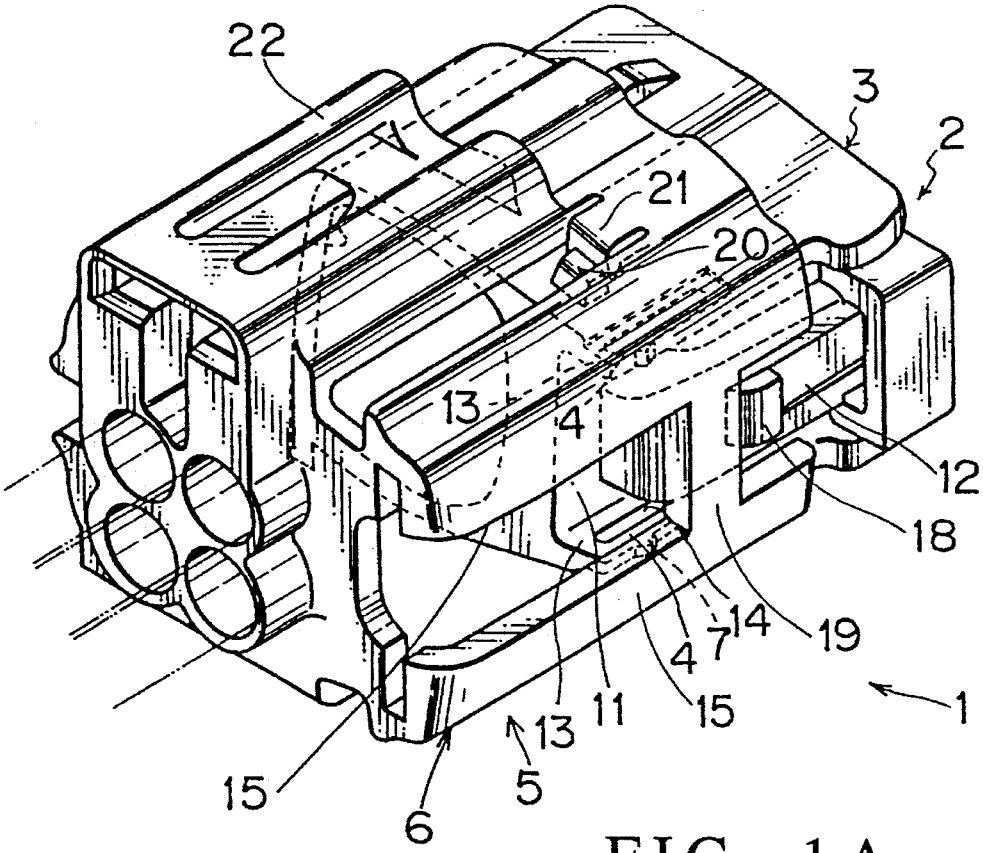
FIG. 1B is a partially enlarged detail view of the disconnection sensing arm of the connector disconnection sensing mechanism shown in FIG. 1A.
Figure 2A:
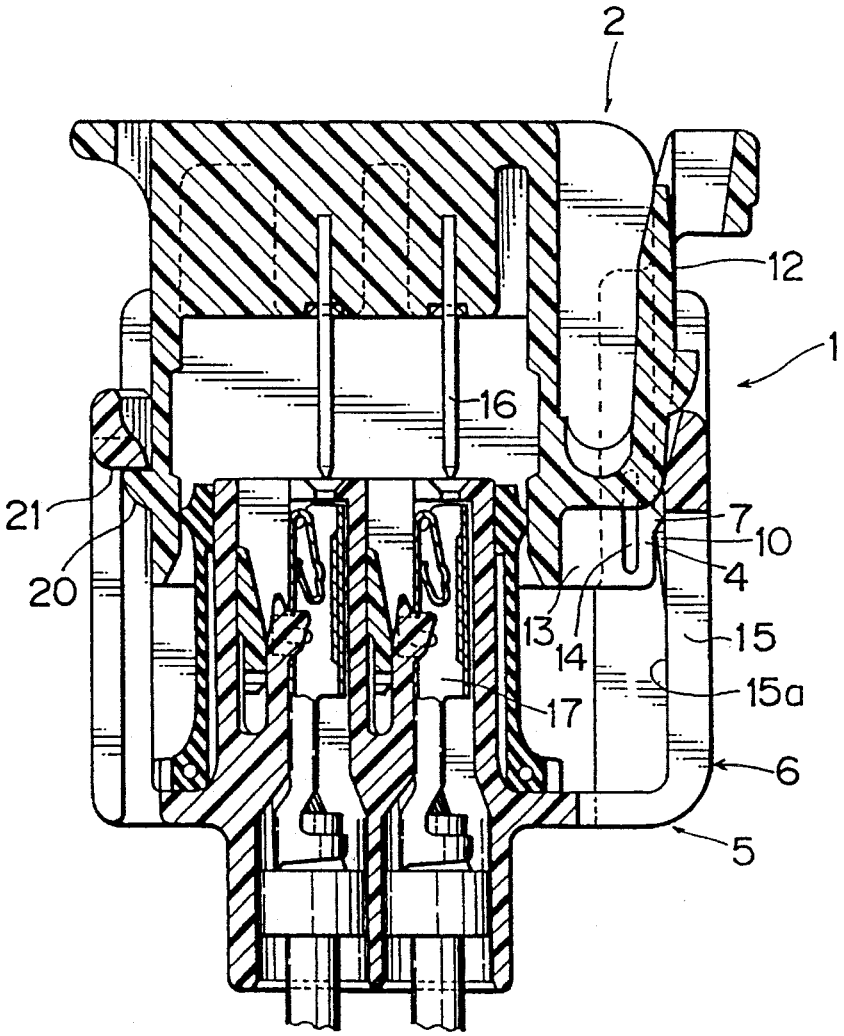
FIG. 2A is a longitudinally cross-sectional view of the connector disconnection sensing mechanism in which both connector halves are disconnected.
Figure 3A:
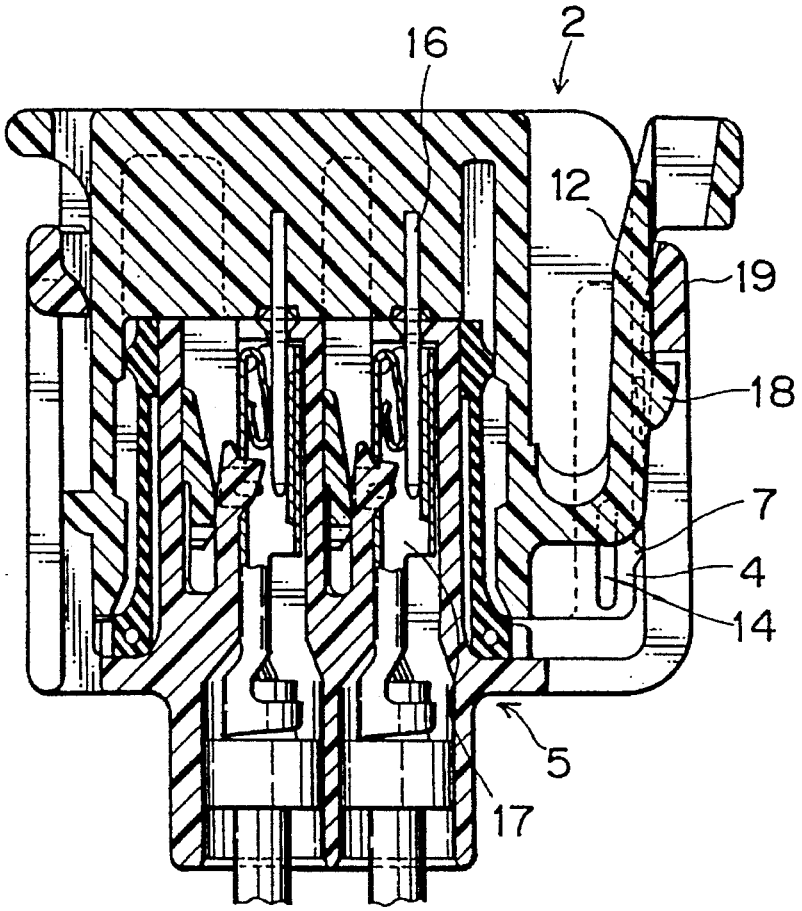
FIG. 3A is a longitudinally cross-sectional view of the connector disconnection sensing mechanism in which the both connector halves are connected.

FIGS. 1A and 2A are a perspective view and a longitudinally cross-sectional view, respectively, of a connector disconnection sensing mechanism according to the first embodiment of the present invention when both connector halves are disconnected. FIG. 3A is a longitudinally cross-sectional view of the sensing mechanism when both connector halves are engaged.

Figure 7:
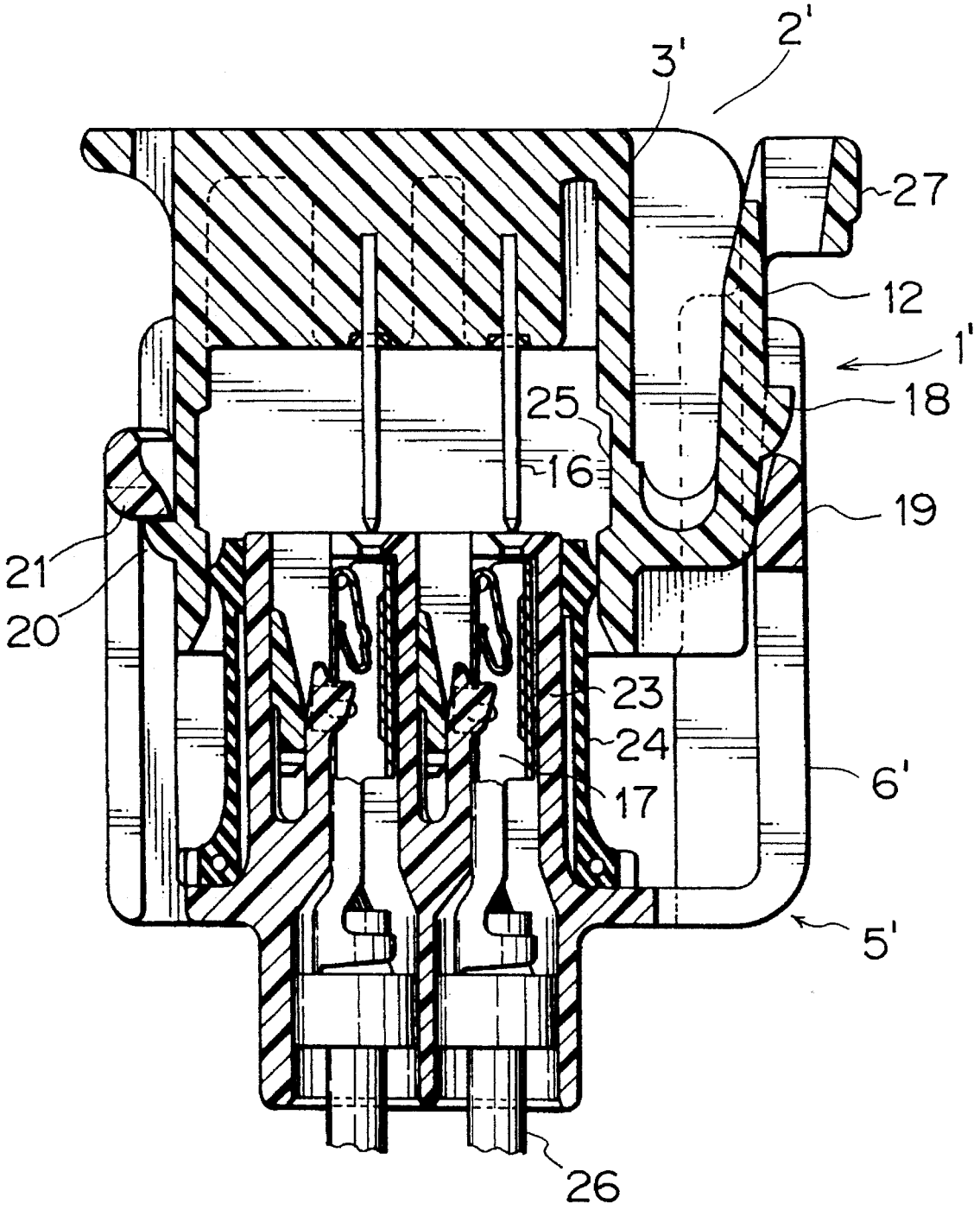
FIG. 7 PRIOR ART
FIG. 7 is a perspective view of a conventional connector disconnection sensing mechanism.

In the connector disconnection sensing mechanism, a pair of resilient connector disconnection sensing arms 4 are formed on a synthetic resin housing 3 of a slide female connector half 2 of a switch connector 1, having a similar construction as the conventional connector half illustrated in FIG. 7. Further, a pair of guide projections 10 are formed on a synthetic resin housing 6 of a fixed male connector half 5. The guide projections 10 are provided with an engagement face 8 having a gentle slope and a steep falling face 9, which abut a central projection 7 of the connector disconnection sensing arm 4. With the structure described above, impact and sound caused by the disconnection of the disconnection sensing arm 4 from the guide portion 10 will allow workers to sense the disconnection of the connector.

Figure 1B:
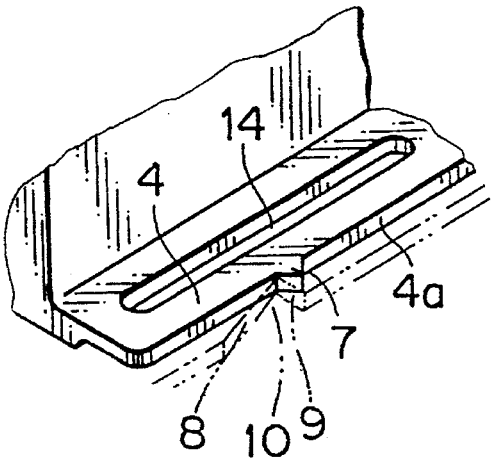

The disconnection sensing arms 4 supported at both ends thereof are formed on the housing 3 of the slide connector half 2 adjacent to a front end thereof. That is, the disconnection sensing arms 4 are located adjacent to front ends of a pair of vertical walls 13 that enclose a resilient locking arm 12 that is attached to an outer wall 11 of the housing 3 from both sides. As seen in FIG. 1B, the sensing arms 4 are formed by providing a slit 14 in the longitudinal direction so as to be resilient in the direction perpendicular to that of the slit 14. The substantially triangular projection 7 is integrally formed with each of the sensing arms 4 at a middle of an outer wall **4*a*** thereof.

The guide projections 10 engaging the disconnection sensing arms 4 are integrally formed with inner walls **15*a* of a pair of substantially L-shaped guide walls 15 of the housing 6 of the fixed connector half 5, which oppose the vertical walls 13. The guide projections 10 each consists of a gentle slope adjacent to a base portion of the housing 6 of the fixed connector 5, and a steep slope, almost perpendicular to the inner wall 15*a*, on the front end side of the housing 6**.

Figure 2B:
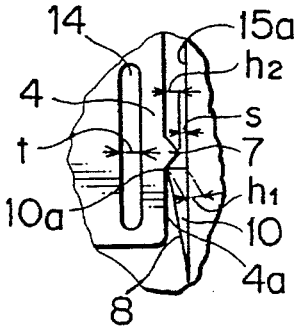
FIG. 2B is a partially enlarged detail view of the disconnection sensing arm of the connector disconnection sensing mechanism shown in FIG. 2A.

As seen in FIG. 2B, the height h1 of the guide projection 10 is set to be slightly taller than the height h2 of the projection 7 of the disconnection sensing arm 4, which provides a slight gap s between a tip of the projection 7 and the inner wall **15*a* of the guide wall when a top 10*a* of the guide projection 10 is in contact with an outer face 4*a* of the disconnection sensing arm 4. The width t of the slit 14 of the disconnection sensing arm 4 is set to be sufficient to bend the arm 4 when the projection 7 slides along the guide projection 10**.

The guide projection 10 is positioned in a predetermined range so that the projection 7 of the disconnection sensing arm 4 moves from the engagement face 8 to the falling face 9 at the moment that the terminal 16 of the slide connector half 2 and the terminal 17 of the fixed connector half 5 move from the connected state to the disconnected state.

Figure 3B:
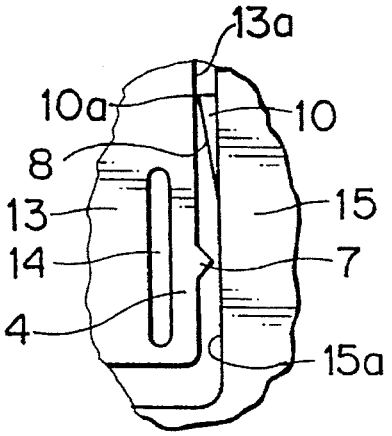
FIG. 3B is a partially enlarged detail view of the disconnection sensing arm of the connector disconnection sensing mechanism shown in FIG. 3A.
Figure 4A:
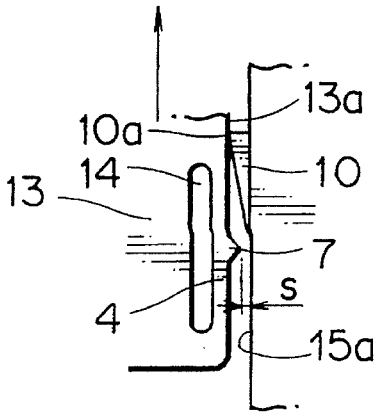
FIGS. 4A to 4C are views for explaining the engagement between a connector disconnection sensing arm and a guide projection, in which 4A shows a condition that connector halves are connected, 4B a condition changing from the connected state to a disconnected state, and 4C a condition that the connector halves are disconnected.
Figure 4B:
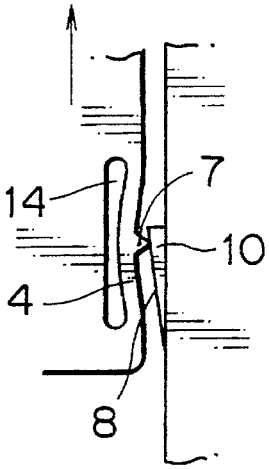
Figure 4C:
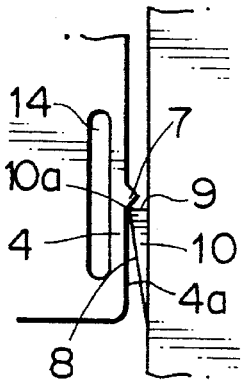

FIGS. 4A to 4C show processes of the engagement between the disconnection sensing arm 4 and the guide projection 10 when the slide connector half 2 is drawn off. FIG. 4A shows the condition that the slide connector half 2 is drawn off from the locking state of the connector illustrated in FIG. 3A by bending the locking arm 12 to disengage the locking projection 18 from the locking wall 19. In this step, and as seen in FIG. 3B the outer wall **13*a* of the vertical wall 13 with the disconnection sensing arm 4 slidably contacts the top 10*a* of the guide projection 10, and the projection 7 of the disconnection sensing arm 4 moves along the inner wall 15*a* of the guide wall 15** with a small gap s in between.

Then, the projection 7 slidably contacts the engagement face 8 of the guide projection 10 as illustrated in FIG. 4B to gradually bend the disconnection sensing arm 4 toward the slit 14. Since the engagement face 8 has a gentle slope attached to the guide projection 10, the force required to disconnect the slide connector half 2 is gradually increased. Therefore, the worker will not feel the change of the force at his fingers.

FIG. 4C shows the disconnection sensing arm 4 and the guide projection 10 under the condition that both connector halves are disconnected from each other as illustrated in FIG. 2A. In this step, the projection 7 of the disconnection sensing arm 4 crosses over the projection 10 to rapidly return the sensing arm 4 to its original shape. As a result, an outer wall **4*a* of the sensing arm 4 collides the top 10*a* of the guide projection 10 to generate an impact and sound, which allows the worker to sense that the switch connector 1 is securely disconnected. The disconnection preventing projection 20 of the slide female connector half 2 abuts the projection 21 of the fixed male connector half 5 the moment the sensing arm 4 returns to its original shape. The disconnected state can be maintained under this condition, which prevents the switch connector 1** from unexpectedly changing to the connected state.

Since the disconnection sensing arm 4 is supported at the both ends thereof, the projection 7 of the sensing arm 4 smoothly contacts the falling face 9 and the engagement face 8 of the projection 10 in both connecting and disconnecting operations, permitting the arm 4 to smoothly bend.

Figure 5A:
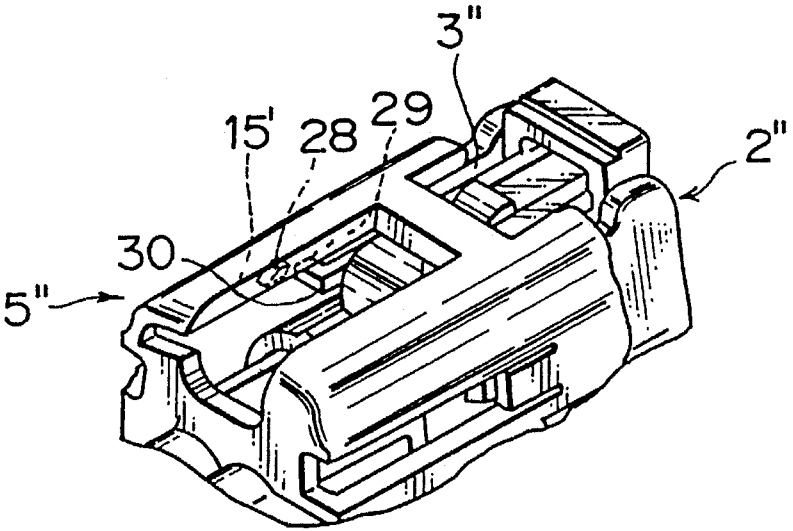
FIG. 5A is a perspective view and partially enlarged view of a connector disconnection sensing mechanism according to a second embodiment of the present invention.

FIG. 5A is a connector disconnection sensing mechanism according to the second embodiment of the present invention.

A substantially triangular fixed or guide projection 28 is attached to an inner wall 15' of a housing of a male connector half 5" with a shape similar to the fixed male connector half 5, and a resilient disconnection sensing arm 30 with a substantially trapezoidal movable projection 29 at a front side thereof, which is to be engaged with the fixed projection 28, is formed on a synthetic resin housing 3" of a female connector half 2".

Figure 5B:
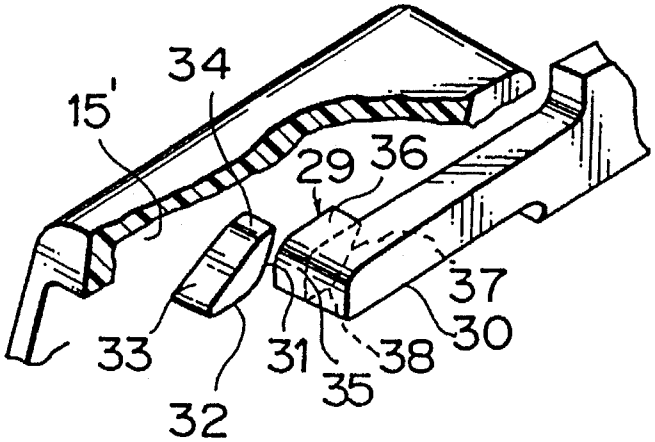
FIG. 5B is a partially enlarged detail view of the disconnection sensing arm of the connector disconnection sensing mechanism shown in FIG. 5A.

As seen in FIG. 5B, the fixed projection 28 is provided with a downwardly inclined falling face 31 where the movable projection 29 crosses, a horizontal bottom face 32 next to the face 31, and an upwardly inclined climbing or engagement face 33 next to the horizontal bottom face 32. The climbing face 33 and the inclined face 31 are connected by a top 34 of the face 33. The movable projection 29 slidably contacts the faces 31 to 33 one after another in such a manner as to draw a loop to bend the disconnection sensing arm 30 upward and to resiliently return the arm 30 to its original shape at the connection and disconnection between the connector halves 2" and 5".

As further seen in FIG. 5B the movable projection 29 consists of a substantially vertical front end face 35, which is to engage the inclined face 31 of the fixed projection 28, a horizontal upper face 36 engaging the horizontal bottom face 32, a downwardly inclined face 37 engaging the climbing face 33, and a horizontal bottom face 38 connecting the inclined face 37 to the front end face 35. The downwardly inclined face 37 is formed so as to be slightly steeper than the climbing face 33 so that the inclination of the face 37 coincides that of the climbing face 33 in accordance with the deflection of the disconnection sensing arm 30.

Figure 6A:
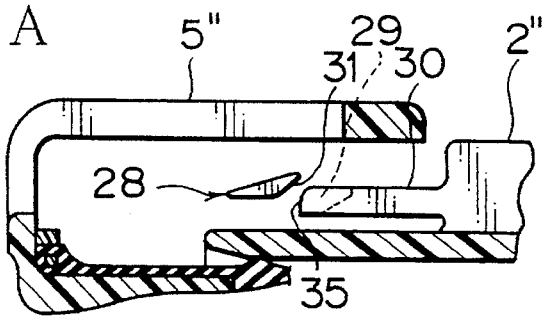
FIG. 6A to 6D are views for explaining the engagement between a connector disconnection sensing arm and a guide projection, in which 6A is a longitudinally cross sectional view illustrating a condition that connector halves are disconnected, 6B a condition changing from the disconnected state to a connected state, 6C a condition that the connector halves are connected; and 6D a condition changing the connected state to the disconnected state.

FIGS. 6A to 6D show the action of the disconnection sensing mechanism described above. Under the condition that both connector halves are disconnected from each other as shown in FIG. 5, the movable projection 29 of the disconnection sensing arm 30 of the male connector half 5" is situated slightly lower than and in front of the fixed projection 28 of the female connector half 2" as illustrated in FIG. 6A.

Figure 6B:
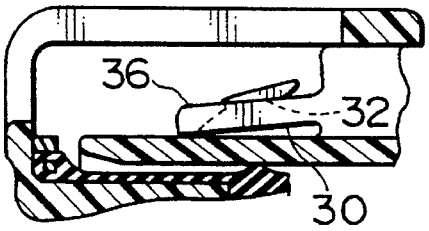
Figure 6C:
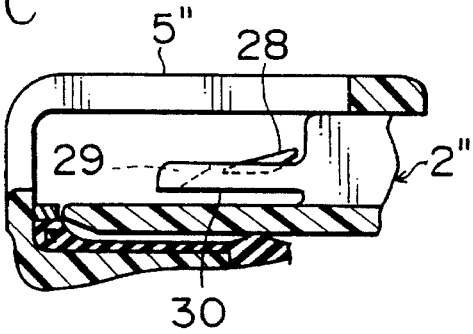

Then, the front end face 35 of the movable projection 29 slidably contacts the face 31 of the fixed projection 28 in accordance with the engagement of the connector halves, and the upper face 36 slidably contacts the horizontal bottom face 32 as illustrated in FIG. 6B so that the disconnection sensing arm 30 bends downwardly so as to recover its original shape with the arm crossing over the fixed projection 28 as illustrated in FIG. 6C. Under this condition, the connector halves 2" and 5" are completely engaged with each other.

Figure 6D:
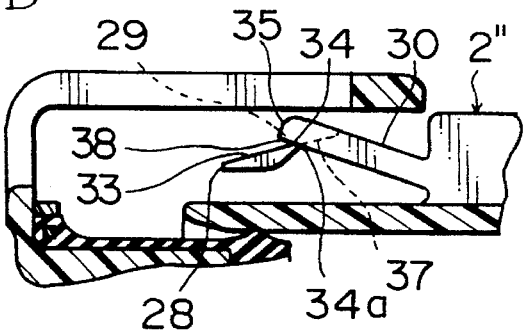

When the connector halves 2" and 5" are disconnected from each other, the lower face 37 of the movable projection 29 moves along the climbing face 33 of the fixed projection 28 to bend the disconnection sensing arm 30 upwardly as illustrated in FIG. 6D. Further, the movable projection 29 moves in the direction away from the fixed projection to engage the horizontal bottom face 38 of the movable projection 29 with the top 34 of the climbing face 33, then the movable projection 29 falls from the top 34 due to the recovery force of the disconnection sensing arm 30. At this moment, the front end face 35 of the movable projection 29 slidably contacts the top 34*a* of the fixed projection 28 to generate sound and vibration, and the disconnection sensing arm 30 returns to its original position with impact, which allows the worker to securely sense the disconnection of the connector halves 2" and 5".

As described above, with the connector disconnection sensing mechanism according to the present invention, the disconnection sensing arms produces impact and sound when the electric circuit is disconnected so that the worker senses the completion of the disconnection. As a result, the disconnection of the connector can completely be carried out, that is, the circuit is securely cut off to prevent energy loss caused by dark current.

What is claimed is:

1. A connector having a disconnection sensing mechanism, the connector comprising:

two mateable connector halves each having a terminal, the two connector halves movable between a connected state so that the terminals form an electrical connection and a disconnected state so that the terminals are electrically disconnected;

one of the two mateable connection halves comprising a resilient disconnection sensing arm including a projection, and a lock arm adjacent to said disconnection sensing arm; and a guide projection provided on the other of the two connector halves, said guide projection having an engagement face with a gentle slope and a falling face with a steep slope, the guide projection being provided so said projection of the resilient disconnection sensing arm first engages the engagement face and bends the resilient disconnection sensing arm when the two connector halves are moved from the connected state to the disconnected state, such that said projection of the resilient disconnection sensing arm is released at the falling face of the guide projection to produce a disconnection signal at the moment when the two connector halves reach the disconnected state, wherein said resilient disconnection sensing arm is extends from a front end of one of the two mateable connector halves, and is separate from the lock arm.

2. A connector disconnection sensing mechanism as claimed in claim 1, wherein said resilient disconnection sensing arm is formed by providing a slit extending in an axial direction of the two connector halves proximate an outer wall of the one of the two connector halves on which the resilient disconnection sensing arm is provided.

3. A connector disconnection sensing mechanism for a connector including two mateable connector halves, the connector operated by movement of the two connector halves between a connected state and a disconnected state, the mechanism comprising:

a resilient disconnection sensing arm having a projection provided on one of the two mateable connector halves, said resilient disconnection sensing arm formed by providing a slit extending in an axial direction of the two connector halves proximate an outer wall of the one of the two connector halves on which the resilient disconnection sensing arm is provided, wherein the slit is spaced from an axial end of the one of the two connector halves on which the resilient disconnection sensing arm is provided so that the resilient disconnection sensing arm includes opposite ends that are connected to and supported by a wall of the one of the two connector halves; and a guide projection provided on the other of the two connector halves, said guide projection having an engagement face with a gentle slope and a falling face with a steep slope, the guide projection being provided so said projection of the resilient disconnection sensing arm first engages the engagement face and bends the resilient disconnection sensing arm when the two connector halves are moved from the connected state to the disconnected state, such that said projection of the resilient disconnection sensing arm is released at the falling face of the guide projection to produce a disconnection signal when the two connector halves reach the disconnected state.

4. A connector disconnection sensing mechanism as claimed in claim 1, wherein the disconnection signal is an impacting sound produced by the resilient disconnection sensing arm.

5. A connector disconnection sensing mechanism as claimed in claim 1, wherein the disconnection signal is an impacting vibration produced by the resilient disconnection sensing arm.

* * * * *

UNITED STATES PATENT AND TRADEMARK OFFICE

CERTIFICATE OF CORRECTION

PATENT NO. : 5,462,450

DATED : October 31, 1995

INVENTOR(S) : Shinji KODAMA et al.

It is certified that error appears in the above-indentified patent and that said Letters Patent is hereby corrected as shown below:

Claim 1, Column 6, Line 36, after "is" insert --integral,--.

Signed and Sealed this

First Day of October, 1996

Bruce Lehman

*Attest:*

BRUCE LEHMAN

*Attesting Officer*

*Commissioner of Patents and Trademarks*